US007073222B1

(12) United States Patent
Skripps

(10) Patent No.: US 7,073,222 B1
(45) Date of Patent: Jul. 11, 2006

(54) MEDICAL PROCEDURE TABLE

(76) Inventor: Thomas K. Skripps, 69 Sycamore Dr., Leominster, MA (US) 01453

( * ) Notice: Subject to any disclaimer, the term of this patent is extended or adjusted under 35 U.S.C. 154(b) by 0 days.

(21) Appl. No.: 10/840,705

(22) Filed: May 6, 2004

Related U.S. Application Data

(60) Provisional application No. 60/468,157, filed on May 6, 2003.

(51) Int. Cl.
*A61G 13/04* (2006.01)

(52) U.S. Cl. ..... 5/618; 5/607; 5/608; 5/610

(58) Field of Classification Search ..... 5/618, 5/607, 608, 610
See application file for complete search history.

(56) References Cited

U.S. PATENT DOCUMENTS

| | | | | |
|---|---|---|---|---|
| 3,362,704 | A | 1/1968 | Pilz | |
| 3,868,103 | A * | 2/1975 | Pageot et al. | 5/614 |
| 4,131,801 | A | 12/1978 | Hogan | |
| 4,225,126 | A | 9/1980 | Lee | |
| 4,501,414 | A * | 2/1985 | Mason et al. | 5/614 |
| 4,558,857 | A * | 12/1985 | Heller | 5/618 |
| 4,761,000 | A | 8/1988 | Fisher et al. | |
| 4,865,303 | A * | 9/1989 | Hall | 5/614 |
| 4,944,500 | A | 7/1990 | Mueller et al. | |
| 5,369,825 | A | 12/1994 | Reesby | |
| 5,477,570 | A | 12/1995 | Hannant et al. | |
| 5,528,782 | A * | 6/1996 | Pfeuffer et al. | 5/611 |
| 5,590,429 | A | 1/1997 | Boomgaarden et al. | |
| 5,621,932 | A | 4/1997 | Strachan | |
| 5,651,150 | A | 7/1997 | Kanitzer et al. | |
| 5,659,909 | A | 8/1997 | Pfeuffer et al. | |
| 6,038,718 | A * | 3/2000 | Pennington et al. | 5/618 |
| 6,237,166 | B1 | 5/2001 | Stalfire | |
| 6,237,172 | B1 | 5/2001 | Morgan, Sr. | |
| 6,349,436 | B1 | 2/2002 | Kreuzer | |
| 6,505,364 | B1 * | 1/2003 | Simmons et al. | 5/600 |
| 6,615,429 | B1 * | 9/2003 | Weil et al. | 5/601 |
| 6,678,908 | B1 * | 1/2004 | Borders et al. | 5/691 |
| 6,681,423 | B1 * | 1/2004 | Zachrisson | 5/610 |
| 6,886,199 | B1 * | 5/2005 | Schwaegerle | 5/607 |

OTHER PUBLICATIONS

Maquet, Getinge/Castle, Inc., Alphamaquet 1150 Universal Operating Table System (2001).

(Continued)

*Primary Examiner*—Frederick L. Lagman
(74) *Attorney, Agent, or Firm*—Iandiorio & Teska

(57) ABSTRACT

A medical procedure table includes a base plate, a base column extending upwards from the base, a shuttle assembly telescopingly mounted to the base column, a carriage pivotably mounted to the shuttle assembly, and a main plate pivotably mounted to the carriage. A roll actuator subsystem includes a roll actuator mounted to the carriage and a piston pivotably connected to an arm, the arm pivotably connected to the main plate, and a linkage pivotably connected between the piston and the carriage.

33 Claims, 15 Drawing Sheets

OTHER PUBLICATIONS

Maquet, Getinge/Castle, Inc., Alphamaxx 1133.02 Universal Operating Table (2001).
Morgan Medesign, Inc., The ELT-M Space-Saving C-Arm Table (2002).
Morgan Medesign, Inc., Medestealth Rail Clamp System, date unknown.
Morgan Medesign, Inc., Morgan MP Series (2002).
Morgan Medesign, Inc., The Perfect C-Arm Table (2002).
Morgan Medesign, Inc., Scatter-Ban Radiation Barrier (2002).
Pure-Logic Medical, Pure-Logic Industries, Inc., SC500 Surgi Class, date unknown.
C.M. Schade, Fluoroscopic Safety (Worldwide Pain Conference, San Francisco, CA, Jul. 2000).

* cited by examiner

MEDICAL PROCEDURE TABLE

RELATED APPLICATIONS

This application claims benefit of U.S. Provisional Application No. 60/468,157, filed May 6, 2003, which is hereby incorporated by reference.

FIELD OF THE INVENTION

This invention relates to medical procedure tables and more specifically a portable modular medical procedure table.

BACKGROUND OF THE INVENTION

The field of medical procedures and surgery has become highly specialized. Very focused procedures are being performed in dedicated environments, creating distinctly separate industries, such as orthopedic surgery, ambulatory surgery, pain management, and endovascular surgery, etc. Equipment has been designed for these markets, which addresses the specific needs of each market. However, no single medical procedure table product is known to have been adaptable as a universal medical procedure table. Fixed tables have the benefit of interchangeability, but not the portability and cost effectiveness for the ambulatory market. Most operating room tables have the benefit of portability, but not the required modularity for any dedicated applications. Moreover, many of the prior art medical procedure tables are expensive and are difficult to maintain.

BRIEF SUMMARY OF THE INVENTION

It is therefore an object of this invention to provide a medical procedure table that can easily accommodate the use of accessories and/or the changing of sections, such as the main section, leg section, back section and/or head section.

It is a further object of this invention to provide such a medical procedure table that is inexpensive and easy to maintain.

The invention results from the realization that a less expensive and easier to maintain medical procedure table can be achieved by using a carriage pivotably mounted to a shuttle assembly, a main plate pivotably mounted to the carriage and a roll actuator subsystem including a roll actuator mounted to the carriage and having a stroke motion in a first direction, and a link subsystem connected between the roll actuator and the main plate and configured to translate the stroke motion of the actuator to motion transverse to the first direction to roll the main plate. The subject invention results from the further realization that a more adaptable medical procedure table includes opposing side guide rails on the main plate and a center section that includes opposing side guide rails and opposing side channels readily received over the opposing side guide rails of the main plate. This way, the same base unit can accommodate a wide variety of different table sections and configurations. With built-in rails, the medical procedure table can be used as a stand-alone traction table, without the use of a table top. The subject invention allows many medical procedure table products to be produced from one low-cost table base.

The subject invention, however, in other embodiments, need not achieve all these objectives and the claims hereof should not be limited to structures or methods capable of achieving these objectives.

In one embodiment, this invention features a medical procedure table comprising a base plate, a base column extending upwards from the base plate, a shuttle assembly telescopingly mounted to the base column, a carriage pivotably mounted to the shuttle assembly, a main plate pivotably mounted to the carriage, and a roll actuator subsystem. The preferred roll actuator subsystem includes a roll actuator mounted to the carriage with a piston pivotably connected to an arm, the arm pivotably connected to the main plate. A linkage is pivotably connected between the piston and the carriage.

In one preferred embodiment, the medical procedure table also includes a tilt actuator subsystem including at least one tilt actuator mounted to the shuttle and including a piston pivotably connected to the carriage for tilting the carriage. The preferred main plate may have opposing side guide rails. A center section includes opposing side channels received over the opposing side guide rails of the main plate. The medical procedure table may further include a back section engageable with the center section, a head section engageable with the back section, and a leg section engageable with the center section. The base plate may include casters mounted on the bottom of the base plate for moving the base plate. The roll actuator may be an electric motor.

This invention also features a medical procedure table comprising a base plate, a base column extending upwards from the base plate, a shuttle assembly telescopingly mounted to the base column, a carriage pivotably mounted to the shuttle assembly, a main plate pivotably mounted to the carriage. The main plate includes a first set of opposing side guide rails. A center section includes opposing side channels received over the first set of opposing side guide rails of the main plate for removing the center section from the main plate and also includes a second set of opposing guide rails for accepting an accessory device.

In one example, a roll actuator includes a piston and a linkage subsystem with an arm pivotably connected to the piston and to the main plate. The linkage subsystem may further include a link pivotably connected to the piston and to the carriage. The first and second sets of opposing side guide rails may have substantially similar cross sectional profiles. The first and second sets of opposing side guide rails may include accessory rails.

This invention further features a medical procedure table including a base plate, a base column extending upwards from the base, a shuttle assembly telescopingly mounted to the base column, a carriage pivotably mounted to the shuttle assembly, and a main plate pivotably mounted to the carriage. A roll actuator subsystem includes a roll actuator mounted to the carriage having a stroke motion in a first direction and a linkage subsystem connected between the roll actuator and the main plate and configured to translate the stroke motion of the actuator to motion transverse to the first direction to roll the main plate.

In the preferred embodiment, the roll actuator includes a piston and the linkage subsystem includes an arm pivotably connected to the piston and to the main plate. The linkage subsystem typically further includes a linkage pivotably connected to the piston and to the carriage.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
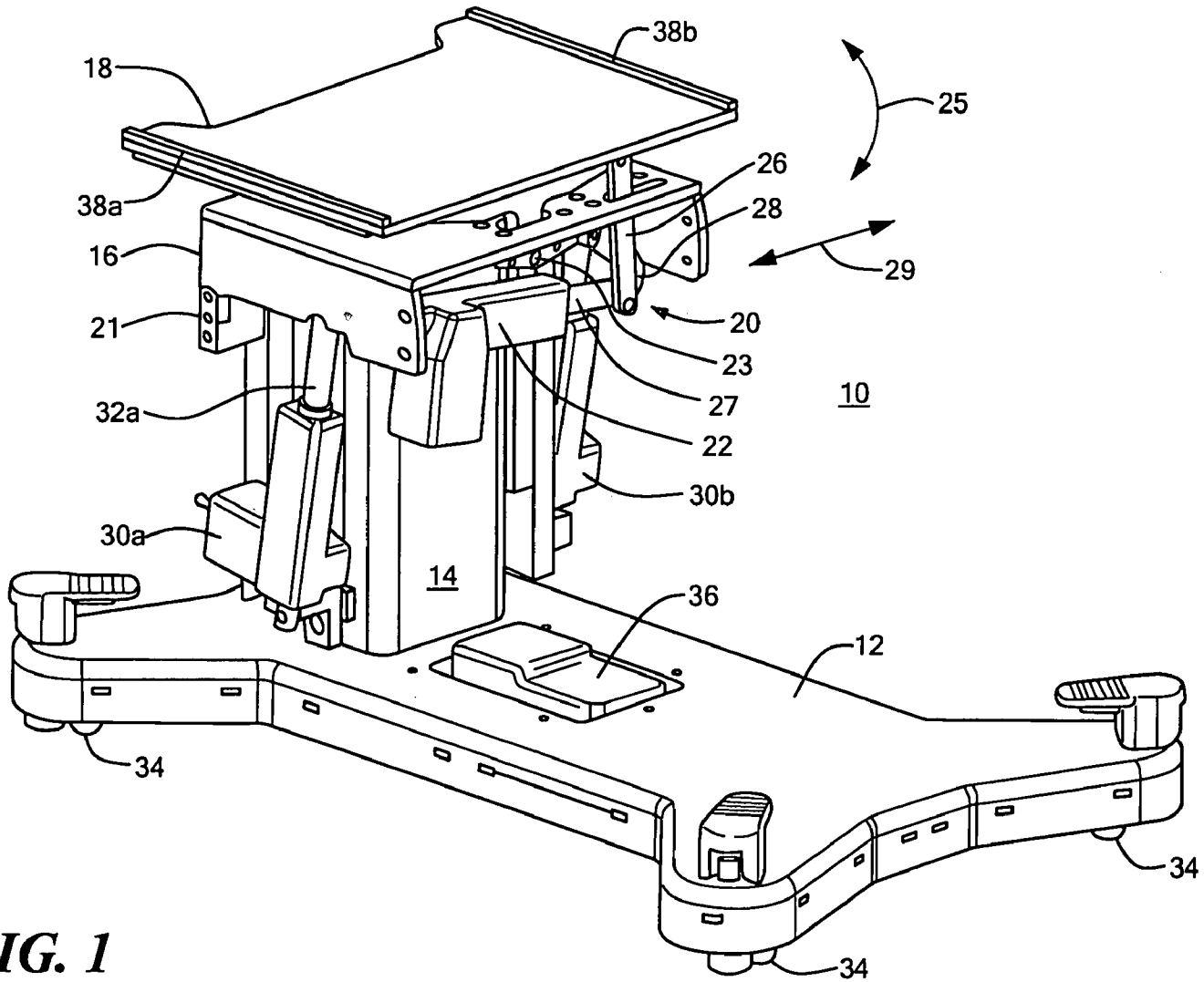
FIG. 1 is a schematic three dimensional view of the base unit of the medical procedure table in accordance with one embodiment of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

A medical procedure table 10, FIG. 1, in accordance with this invention includes base plate 12, a base column 70, FIG. 5, shuttle assembly 14, FIG. 1, carriage 16, main plate 18 and roll actuator subsystem 20. Shuttle assembly 14 is telescopingly mounted to the base column which extends upward from base 12. Carriage 16 is connected to shuttle assembly 14 by pivots 21. Tilt actuators 30*a* and 30*b*, which may be electric motors, are each mounted to shuttle assembly 14 and include pistons 32*a* and 32*b* connected to carriage 16 for tilting the carriage. Main plate 18 is pivotably mounted to carriage 16. Specifically, main plate 18 is connected to pivot 23 and another similar hinge (not shown) on shuttle 16. Roll actuator subsystem 20 is configured to roll main plate 18 in the direction of arrow 25 about pivot 23. Base plate 12 typically includes one or more casters 34 connected to the bottom of base plate 12 to move medical procedure table 10, thus making it portable. Base plate 12 also includes compartment 36 for housing the electronics which control the tilt actuators 30*a* and 30*b*, as well as roll actuator 22 which are typically all the same size electric motors.

Roll actuator subsystem 20 preferably includes roll actuator 22 mounted to carriage 16 and includes piston 27. Piston 27 is pivotably connected to arm 26 which is itself pivotably connected to main plate 18. Linkage 28 is pivotably connected between piston 27 and carriage 16. Since roll actuator 22 is mounted in a substantially horizontal position, piston 27 has a stroke motion in a first direction, indicated by vector 29, and is configured to use a linkage subsystem as shown to translate the stroke motion of actuator 22 to motion in a direction transverse to direction 29, to roll main plate 18 in the direction of arrow 25. The linkage subsystem includes linkage 28 and arm 26. Roll actuator 22 may be an electric motor.

Figure 10:
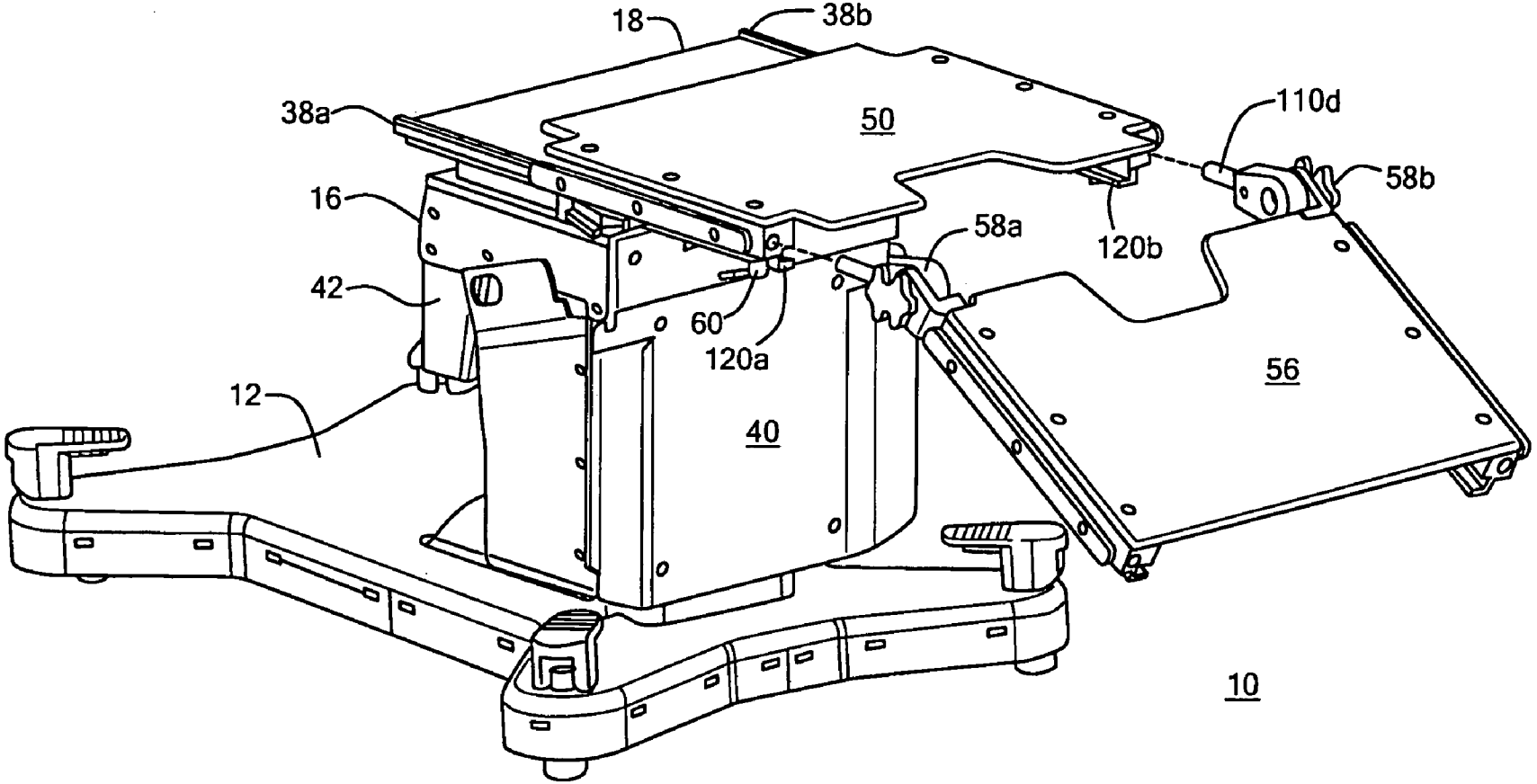
FIG. 10 is a schematic three dimensional view of the medical procedure table of FIG. 3 with the leg section exploded.
Figure 11A:
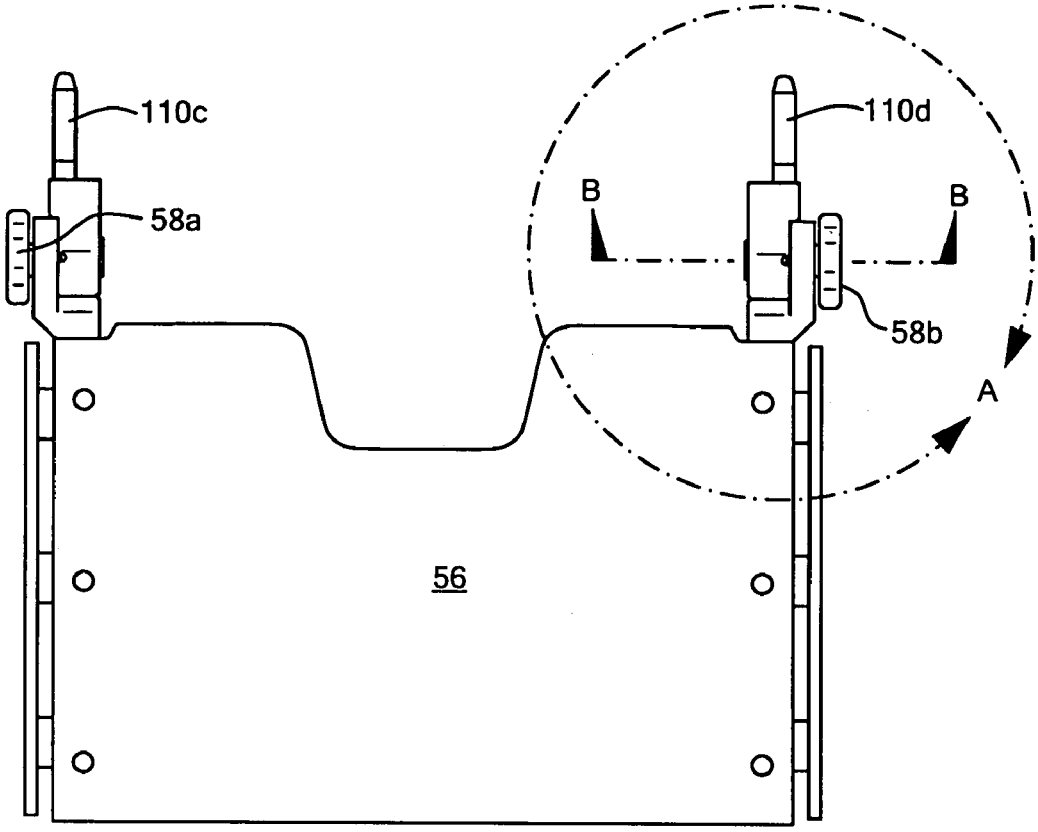
FIG. 11A is a top view of the leg section of FIG. 10.
Figure 11B:
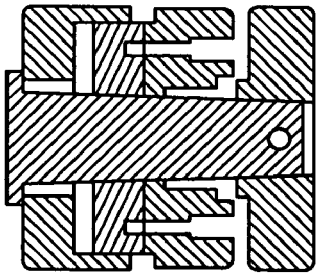
FIG. 11B is a top detail view of the hinge of the leg section of FIG. 11A.
Figure 11C:
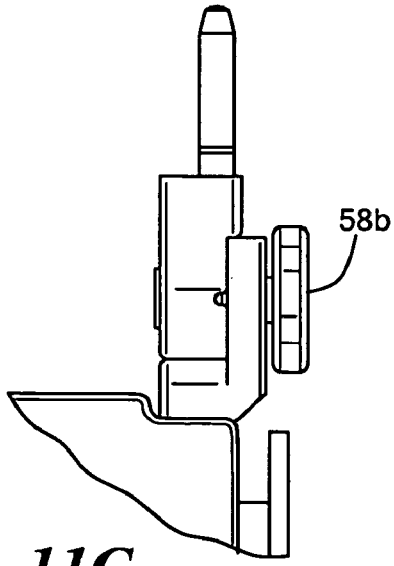
FIG. 11C is a sectional view of the hinge of the leg section of FIG. 11A.
Figure 12:
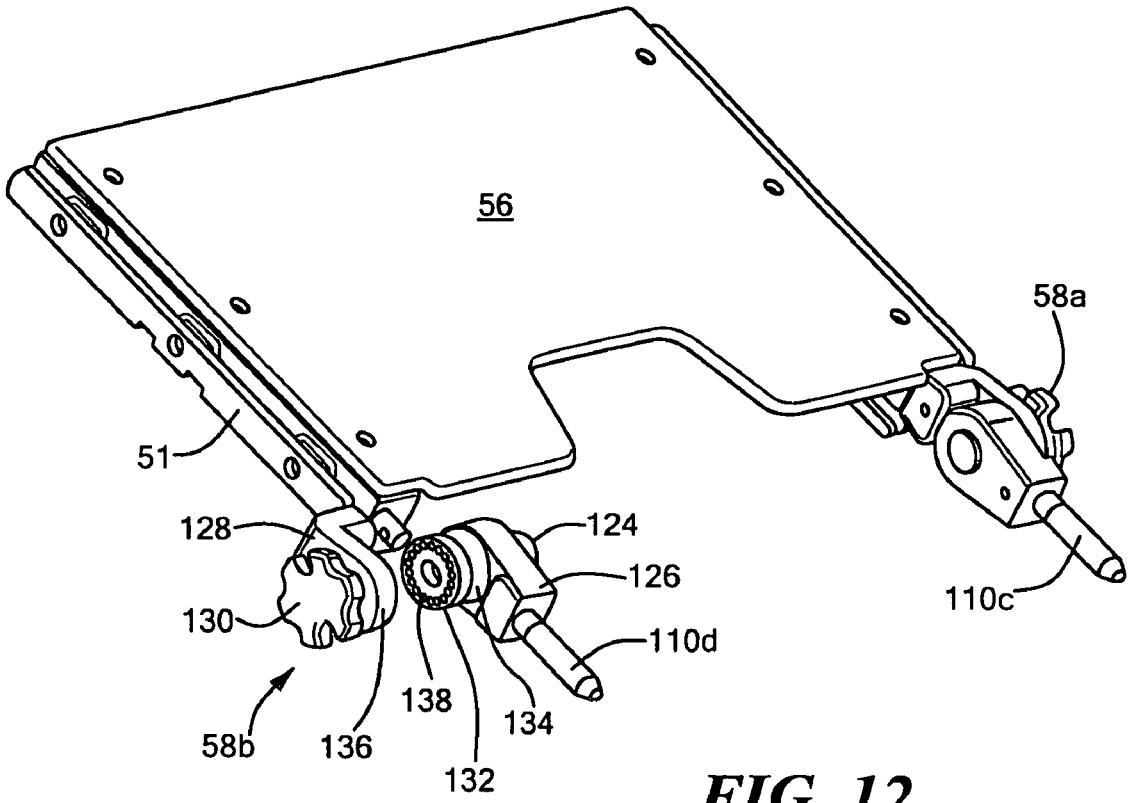
FIG. 12 is a schematic three dimensional view of the leg section of FIG. 11 with the joint section exploded.

Main plate 18 preferably has rounded edges and includes opposing side guide rails 38*a*, 38*b* to receive center section 50, FIG. 10, over the opposing side guide rails.

Figure 2:
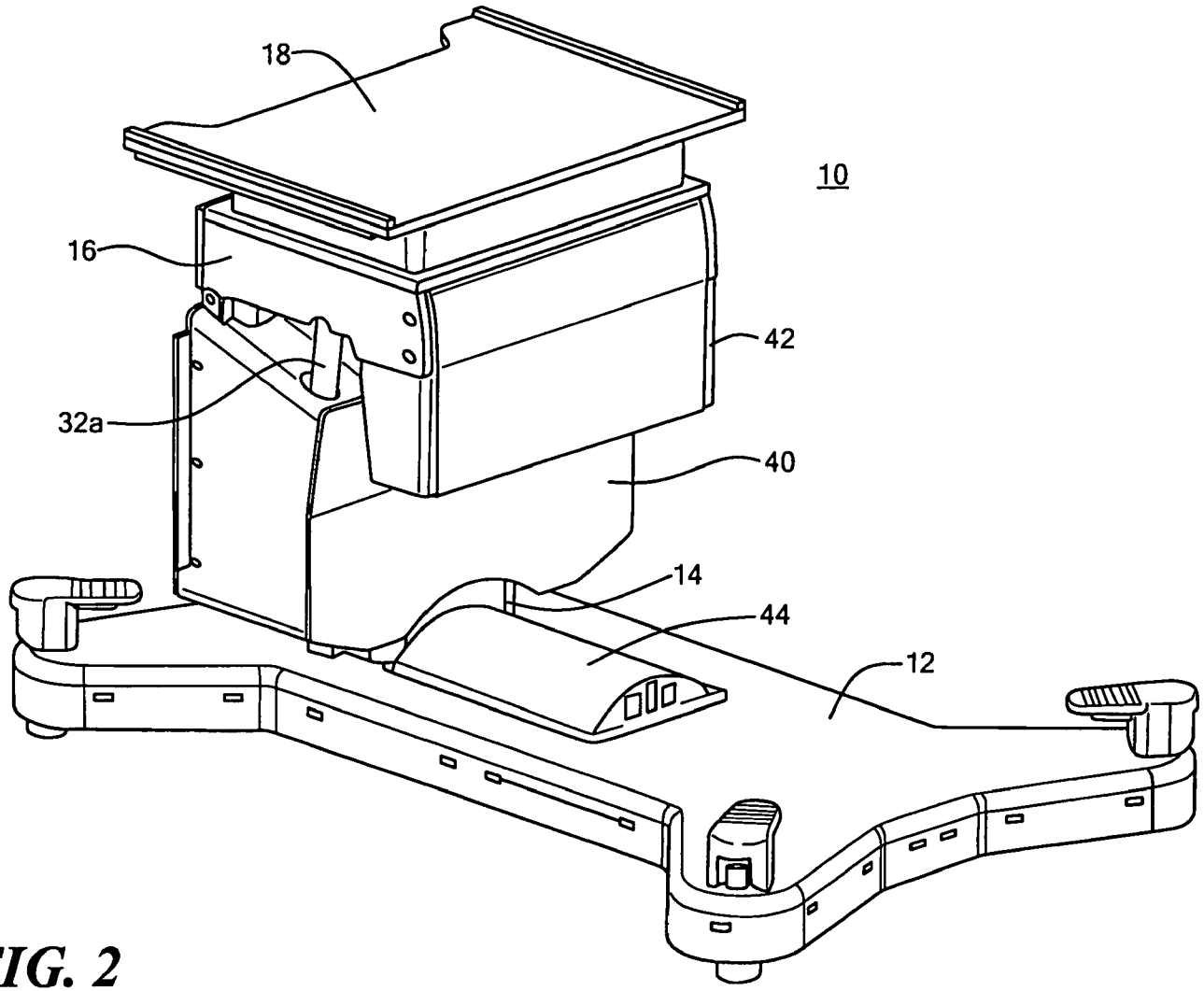
FIG. 2 is a schematic three dimensional view of the medical procedure table of FIG. 1 that shows the carriage actuators.

Housing 40, FIG. 2, encloses shuttle assembly 14 and actuators 30*a* and 30*b* shown in FIG. 1 to make medical procedure table 10 safe enough to use in a hospital environment. Likewise, housing 42 encloses roll actuator subsystem 20, FIG. 1. Cover 44 is provided to house the electronics 36 located therein.

Figure 3:
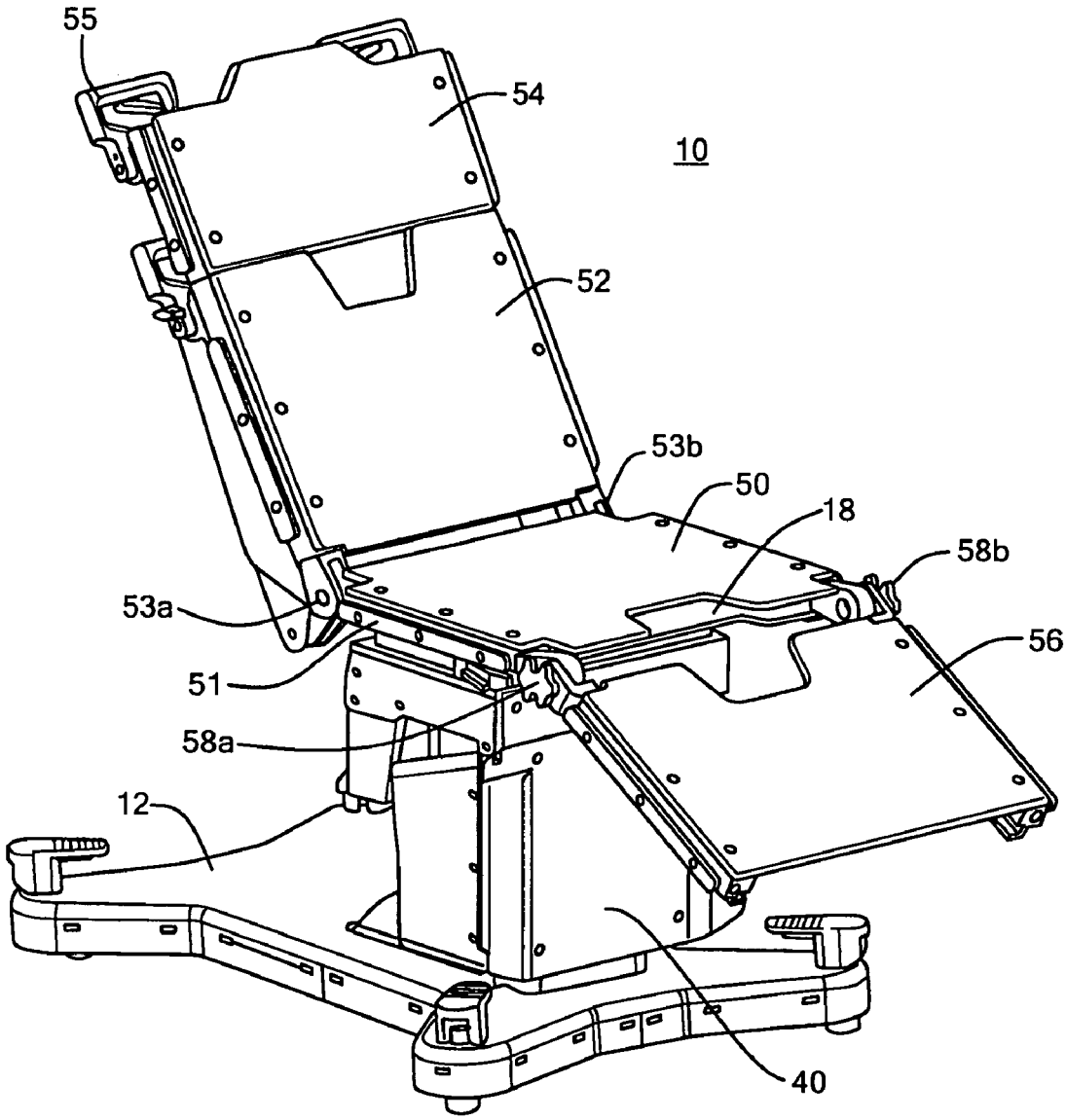
FIG. 3 is a schematic three dimensional view of the medical procedure table of FIG. 1 that includes a center section, a leg section, a back section and a head section.

Table center section 50, FIG. 3, includes side frames 51 on each edge each having opposing side channels to attach center section 50 to main plate 18. Back section 52 engages center section 50 through opposing hinges 53*a*, 53*b*. Head section 54 engages back section 52 and may be adjusted using sliding mechanism 55. Leg section 56 engages center section 50 through locking joints 58*a* and 58*b*. Sections 50, 52, 54 and 56 may include patient support surfaces thereon and also may be constructed of an X-ray translucent material.

Figure 4:
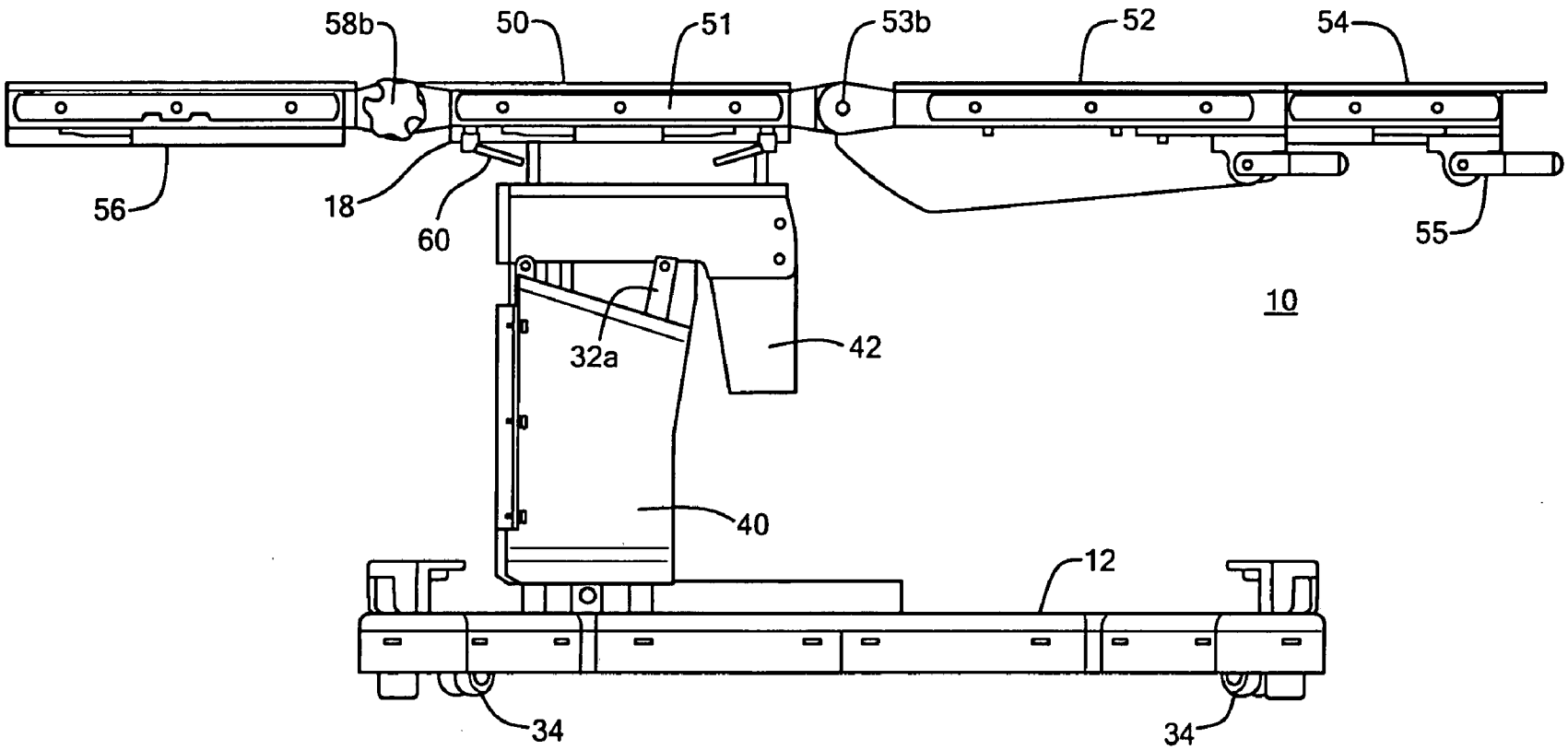
FIG. 4 is a side view of the medical procedure table of FIG. 3 in a flat position.

A locking handle and mechanism 60, FIG. 4, may be used to lock center section 50 to main plate 18. Sections 50, 52, 54 and 56 are adjustable using hinges 53*b*, 58*b* and may be positioned in a flat configuration as shown in FIG. 4.

Figure 5A:
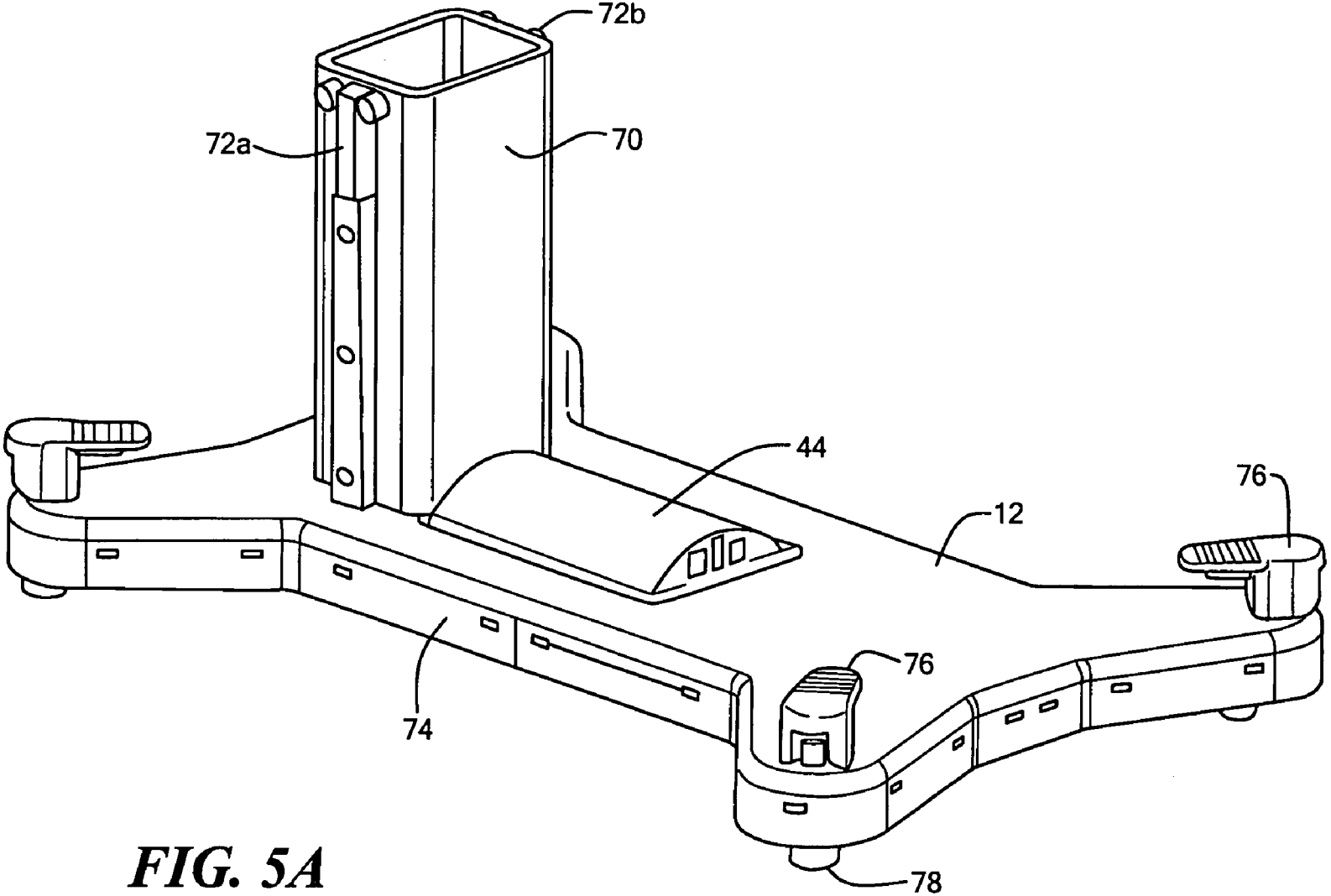
FIGS. 5A and 5B are schematic three dimensional views, respectively, of the base plate and base column of the medical procedure table of FIG. 1.
Figure 5B:
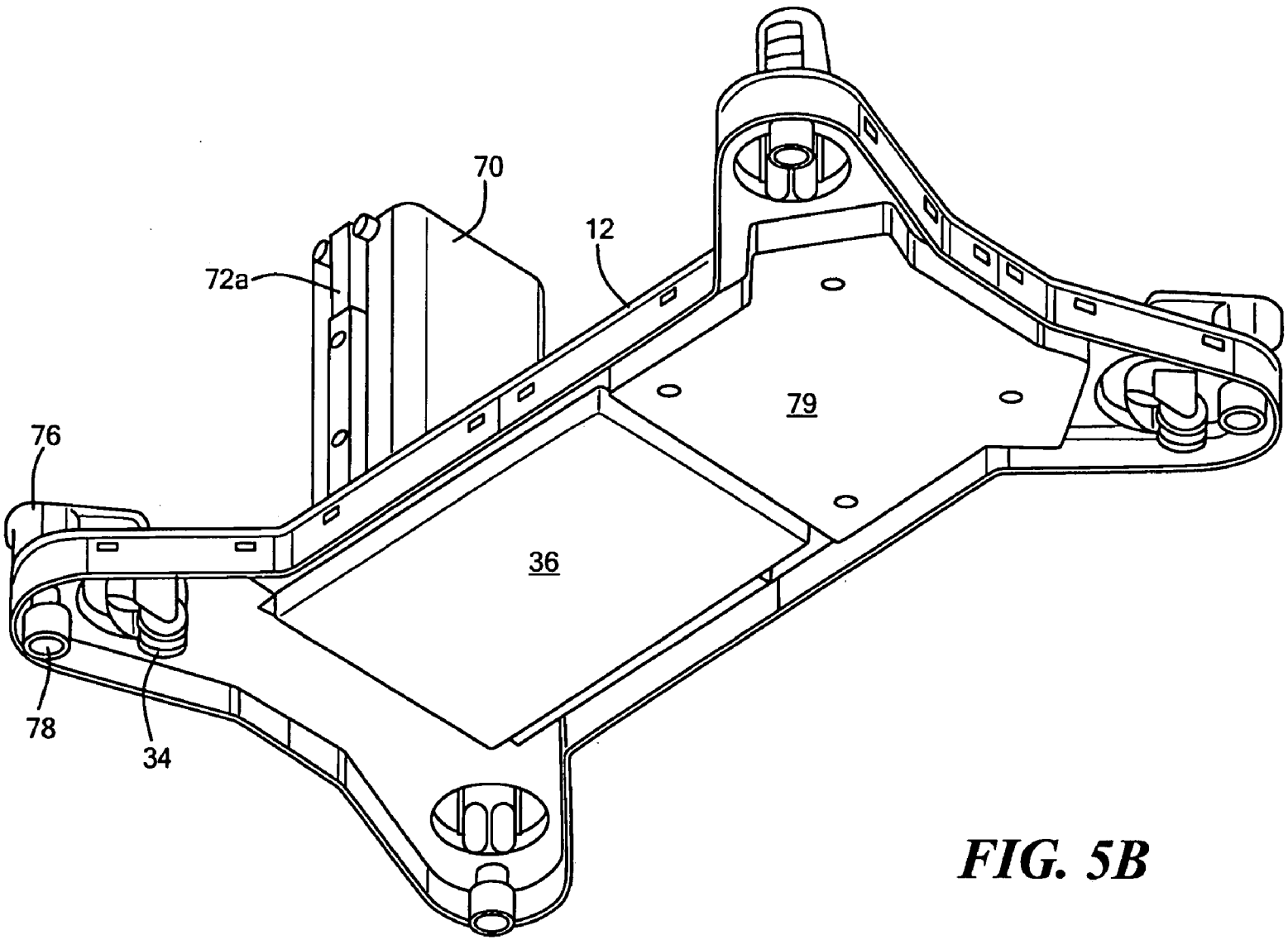

Base column 70, FIG. 5A, extends upwards from base plate 12. Column 70 includes opposing rails 72*a* and 72*b* on which shuttle assembly 14, FIG. 1, is raised or lowered. Base 12 includes a protective skirt 74 and levelers 76 which raise or lower leveler feet 78 for leveling base 12 once it is in a desired location. Counterweight 79, FIG. 5B, attached to the bottom of base 12 provides the base with a low center of gravity.

Figure 6:
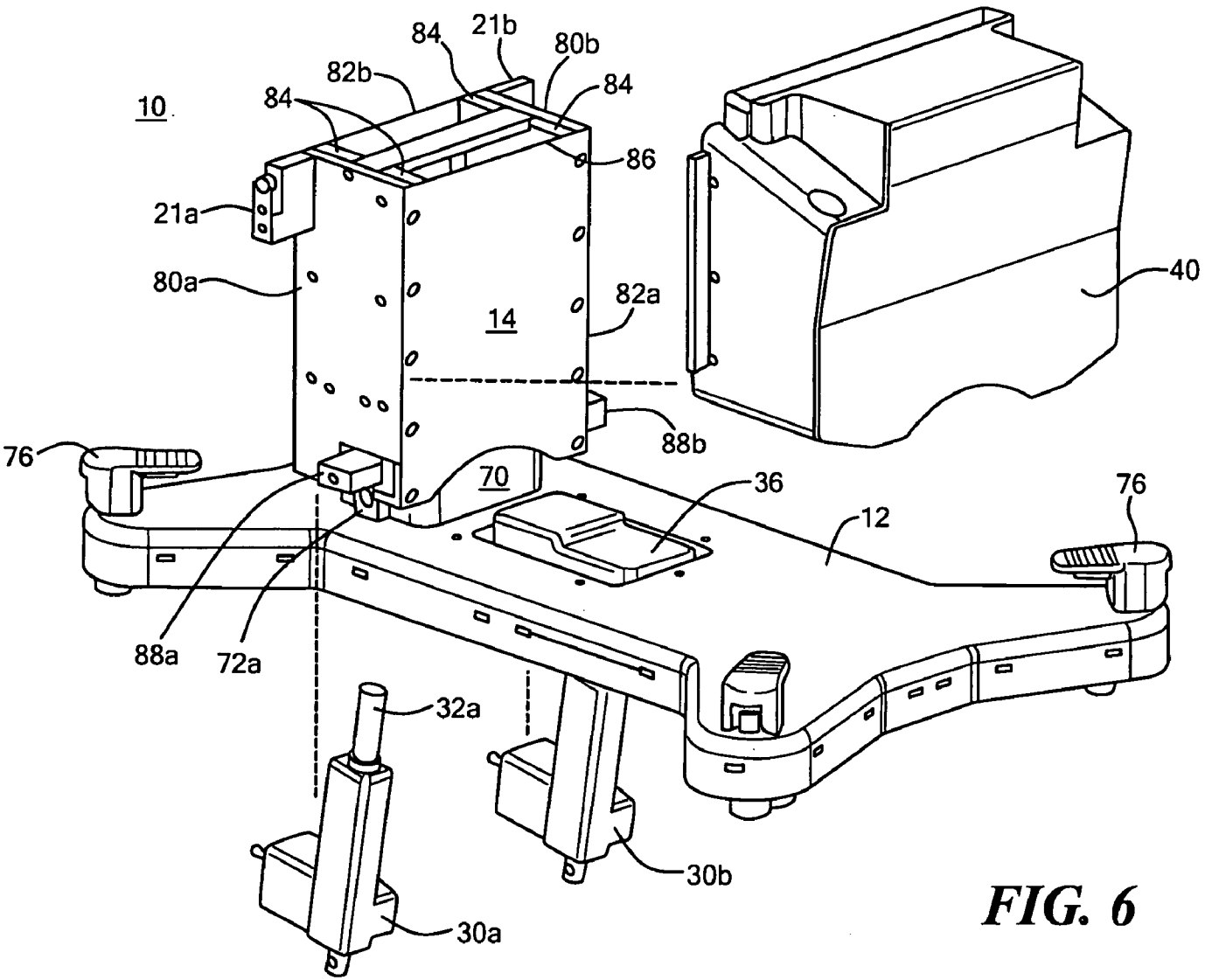
FIG. 6 is a schematic three dimensional view of the telescoping shuttle assembly of the medical procedure table of FIG. 1.

Shuttle assembly 14 includes side plates 80*a* and 80*b*, FIG. 6, and front and rear plates 82*b* and 82*a*. Two cam follower rails 84 are coupled to each of side plates 80*a* and 80*b* for allowing shuttle assembly 14 to be telescopingly mounted to base column 70. Side plates 80*a* and 80*b* each include an opposing side channel (not shown) to accept rails 72*a* and 72*b*, FIG. 5. A telescoping actuator subsystem includes at least one telescoping actuator (not shown) mounted to base plate 12 and includes a piston for raising and lowering shuttle 14. Crossbar 86 is mounted between sideplates 80*a* and 80*b* to provide stability for shuttle assembly 14. Shuttle assembly 14 includes mounting brackets 88*a* and 88*b* to which actuators 30*a* and 30*b*, respectively, are pivotably connected. Housing 40 encloses shuttle assembly 14 and actuators 30*a* and 30*b*.

Figure 7:
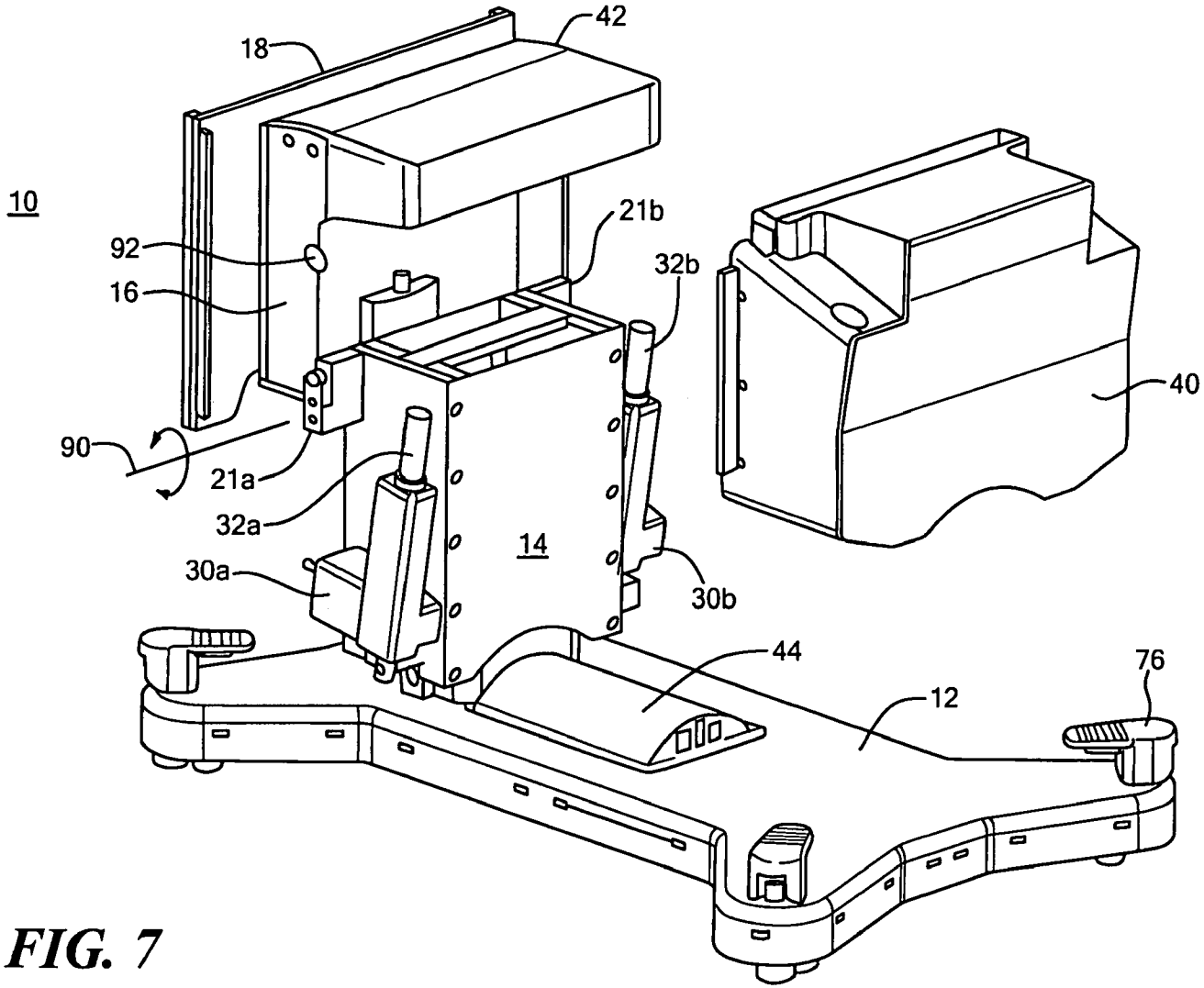
FIG. 7 is a schematic three dimensional view of the carriage of the medical procedure table of FIG. 1.

Carriage 16 is pivotably mounted to pivot blocks 21*a* and 21*b* and pivots about a pivot axis indicated by line 90, FIG. 7. Carriage 16 is shown in FIG. 7 as being in an upright position in which carriage 16 may be placed for easy maintenance of shuttle assembly 14. In operation, piston 32*a* will typically engage plate 92 of carriage 16 to tilt the carriage as desired.

Figure 8:
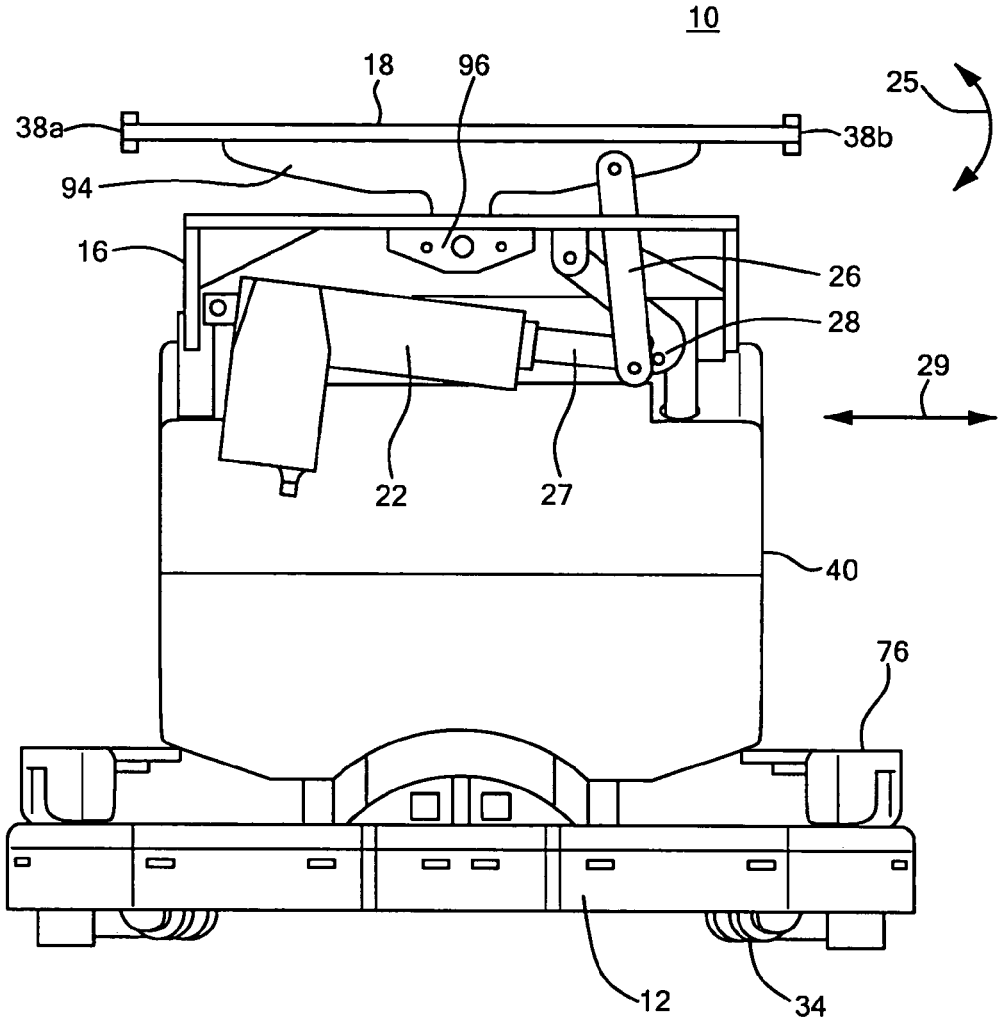
FIG. 8 is a front view of the roll actuator subsystem and associated linkage for the medical procedure table of FIG. 1.

Main plate 18 includes one or more yoke plates 94, FIG. 8, attached to the bottom of the main plate. The one or more yokes 94 are connected to carriage 16 through pivot 96. Arm 26 connects yoke 94 and piston 27 for rolling base plate 18 in the direction of vector 25. Actuator 22 is located in a substantially horizontal position and has its piston moving in a direction indicated by vector 29 that is substantially transverse to the direction indicated by arrow 25. As such, medical procedure table 10 is compact and more maneuverable.

Figure 9:
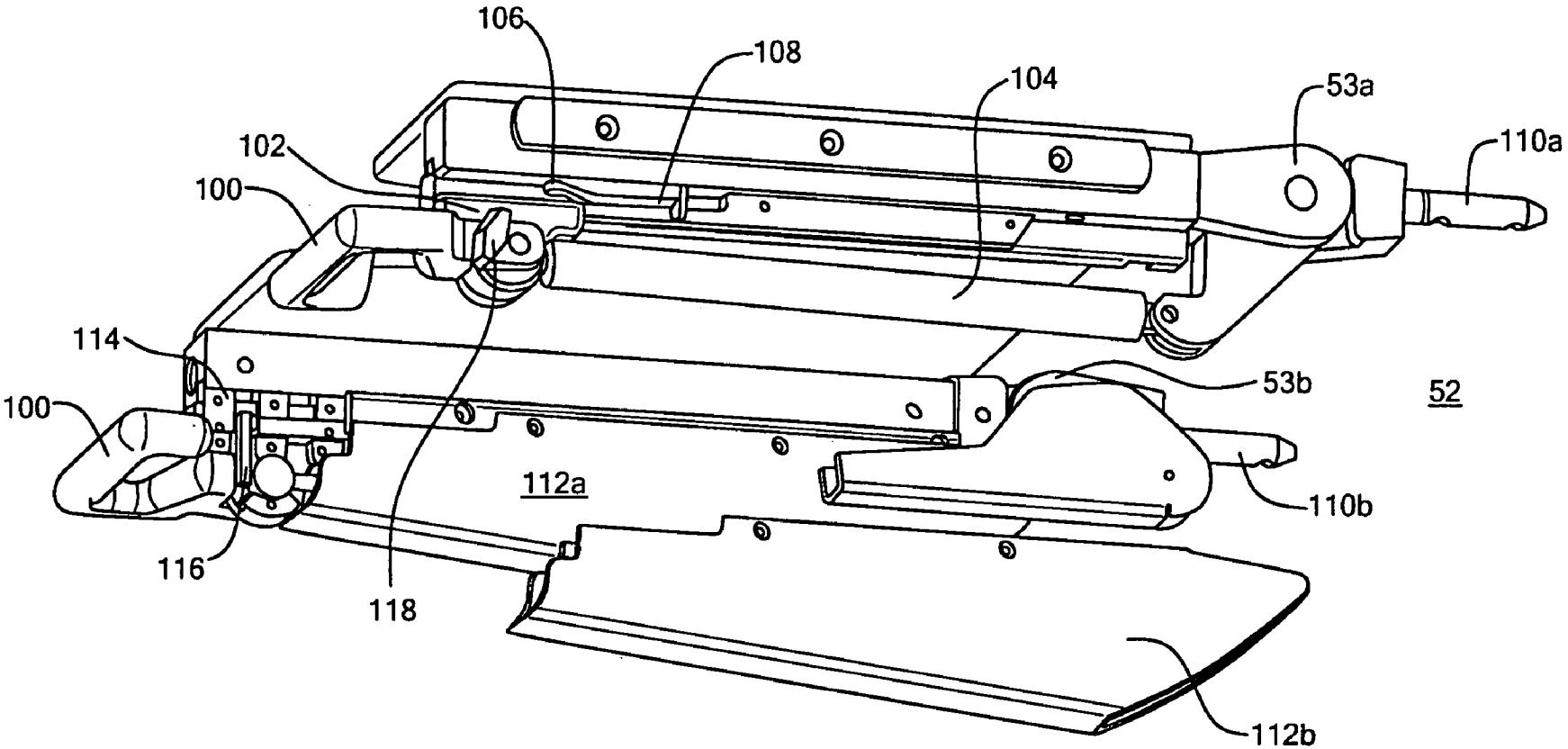
FIG. 9 is a schematic three dimensional view of the back section of the medical procedure table of FIG. 3.

Back section 52, FIG. 9, includes joints 53*a* and 53*b*, adjustment handle 100, pivot mount 102, locking spring damper 104, spade retention pin 106, latch 108, spades 110*a* and 110*b*, and covers 112*a* and 112*b*. Pivot mount 102 allows for adjustment, pivoting, and actuation of spring damper 104 and also provides a mounting location for handles 110. T-nuts 114 affix pivot mount 102 to back section 52 and have guide holes for push rods 116. Push rod 116 extends between handle 100 and an actuation point of spring damper 104, which allows damper 104 to be actuated by handle 100 or another device that presses on push rods 116. Handles 110 include release mechanism 118 to allow them to pivot out of the way. The design of back section 52 provides for the ability to change spring damper 104 to an electric or hydraulic actuator. Back section 52 may also be replaced by an arthroscopy frame.

Center section 50 includes opposing side channels 120*a* and 120*b*, FIG. 10, for receiving side guide rails 38*a* and 38*b* of main plate 18 for easily removing center section 50 from main plate 18. Center section 50 also includes a locking handle 60 for rigidly affixing center section 50 to base plate 18.

Leg sections 56, FIGS. 11A–C and 12, include locking joints 58*a* and 58*b* to position leg section 56 at varying angles. Locking joints 58*a* and 58*b* each include threaded shaft 124 passing through fixed inner joint 126 and outer joint 128 which are captured by a flange on one end of shaft 124 and by knob 130 on the opposite end.

Floating gear 132 travels on the threads of shaft 124 and is restrained from rotations by guide pins 134 in inner joint 126. Outer joint 128 contains spring loaded pins 136 which engage a pattern of holes 138 in the floating gear as the gear is drawn towards outer joint 128. When pins 136 are engaged in floating gear 132, locking joint 58*a* or 58*b* is restrained from articulation.

Figure 13:
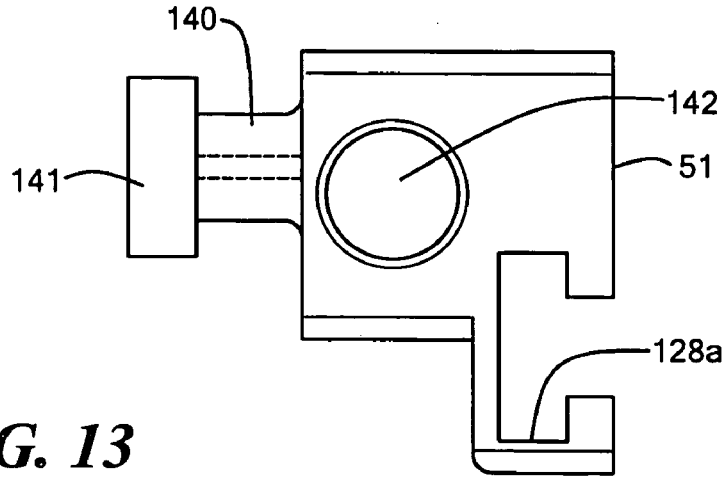
FIG. 13 is a profile view of the side frame member of the medical procedure table of FIG. 3.

Side frame 51, FIG. 13, includes a side channel 128*a*, accessory rail spacer 140, accessory guide rail 141 and hole 142 for accepting the end of a spade 110*a*. Accessory guide rail 141 is attached to side frame 51 to provide opposing guide rails for allowing the attachment of an accessory device on each of sections 50, 52, 54 and 56. Accessory guide rail 141 may have the same or substantially the same cross sectional profile as either of the opposing rails 38*a* and 38*b*, FIG. 10. Either of opposing rails 38*a* and 38*b* are sized to be accepted in side channel 128*a*.

Opposing side guide rails 38*a*, 38*b*, FIG. 10, as well as accessory guide rail 141, FIG. 13, on each side frame 51 and may be or include an accessory rail, which are known in the art. Typically, an accessory rail manufactured in the United States has the cross sectional dimensions of ⅜ inch× 1⅛inch. An accessory rail manufactured in Europe typically has the cross sectional dimensions of 10 mm×25 mm. If opposing side guide rails 38*a*, 38*b*, FIG. 10, are accessory rails, then center section 50 need not be attached to main plate 18 to use the main plate and one or more accessories may be attached to rails 38*a*, 38*b*.

Figure 14:
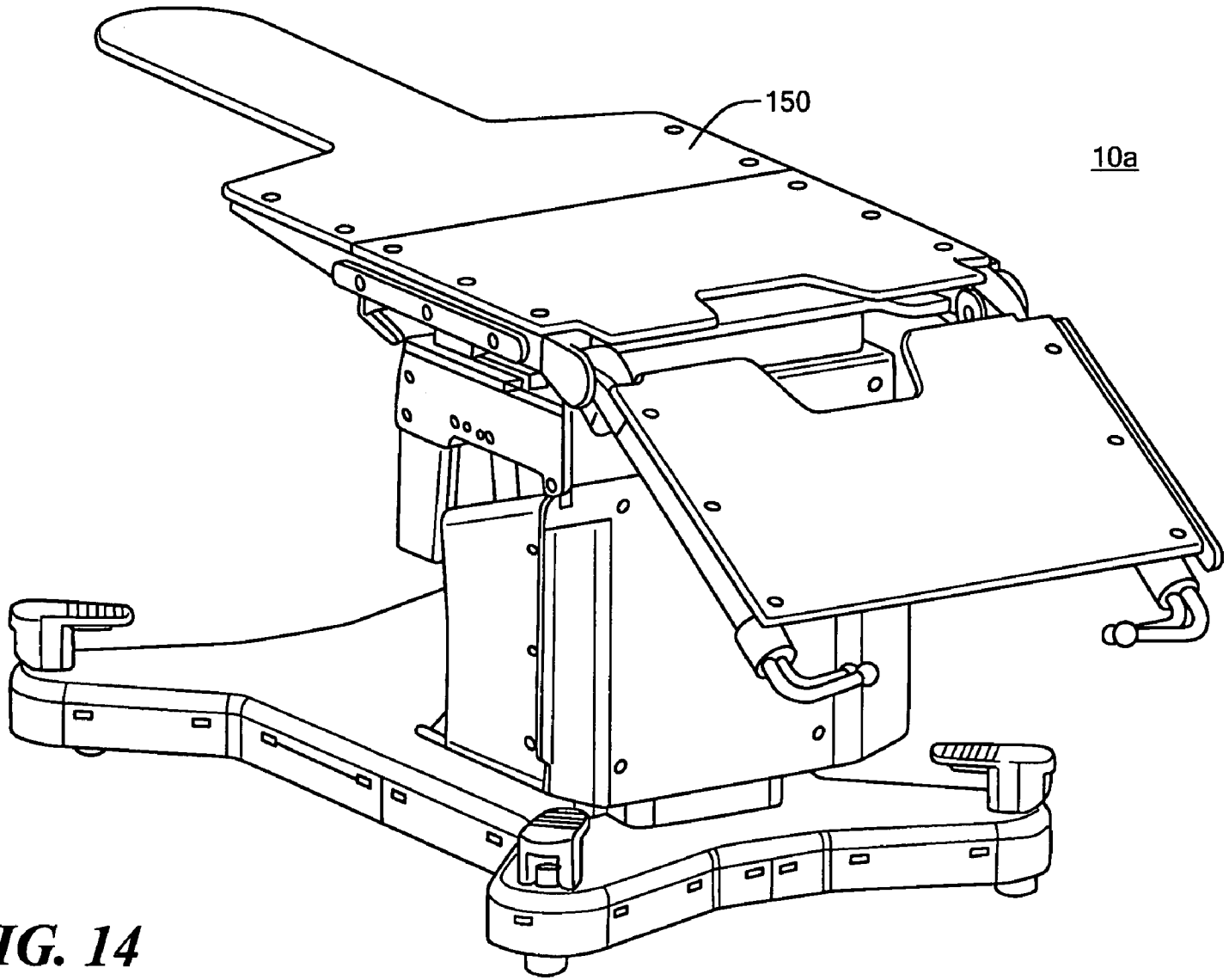
FIG. 14 is a schematic three dimensional view of the medical procedure table of FIG. 1 including an arthroscopy back section and quick release leg section.
Figure 15:
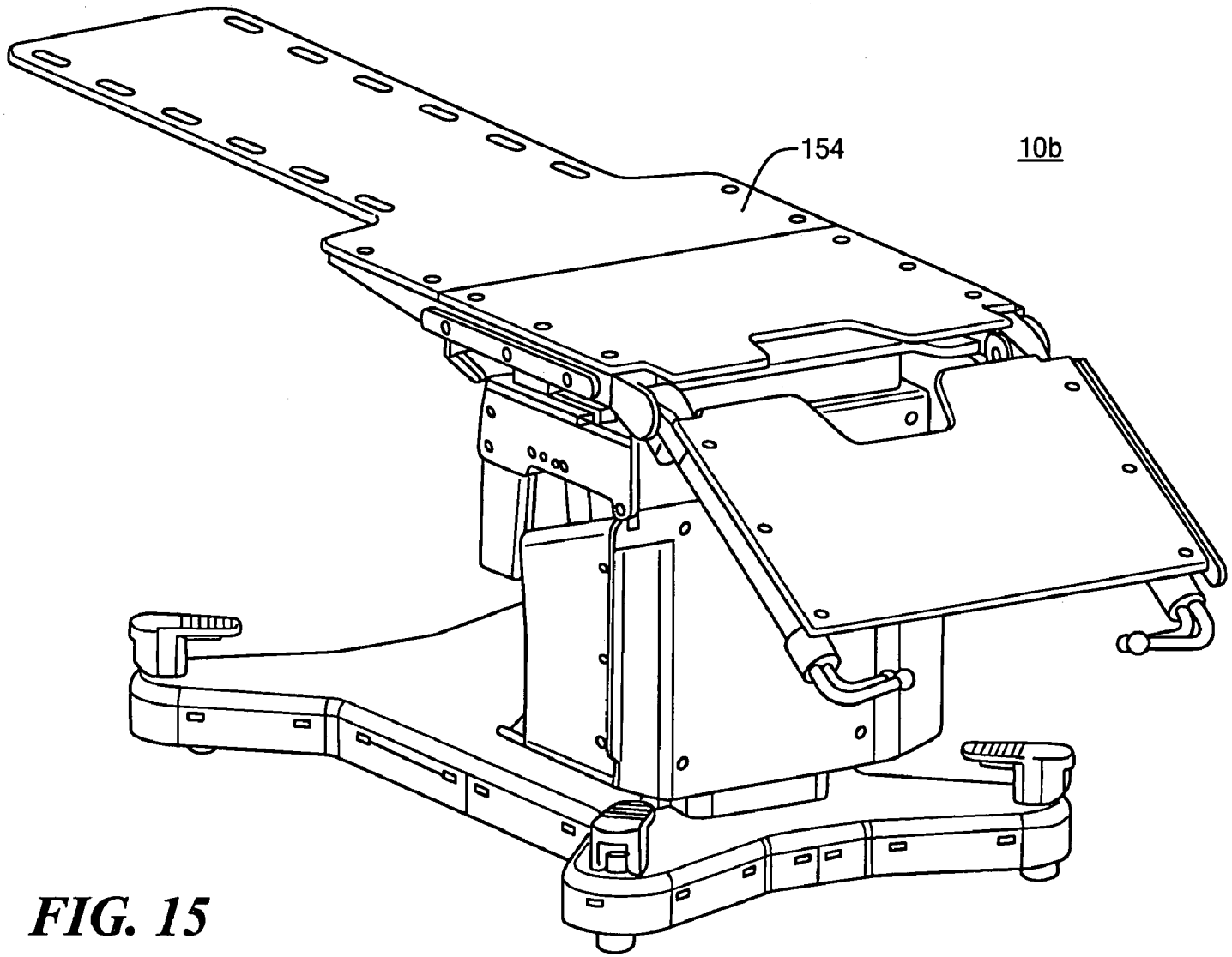
FIG. 15 is a schematic three dimensional view of the medical procedure table of FIG. 1 including a pediatric back section.

An advantage of the subject invention is that center section 50 may be easily attached to or removed from main plate 18 and that leg section 56 and back section 52 may be easily attached to or removed from center section 50. Likewise, head section 54 can be easily adjusted, attached to or removed from back section 52. FIG. 14 shows one embodiment 10*a* of a medical procedure table that includes arthroscopy top 150 and a quick release section. FIG. 15 shows another embodiment of medical procedure table 10*b* that includes pediatric top 154. The medical procedure table 10*a* and 10*b* may be easily obtained from changing the appropriate sections from medical procedure table 10 in FIG. 3 since sections may be easily attached or removed.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A medical procedure table comprising:

a base plate;

a base column extending upwards from the base plate;

a shuttle assembly telescopingly mounted to the base column;

a carriage pivotably mounted to the shuttle assembly;

a main plate pivotably mounted to the carriage; and a roll actuator subsystem including:

a roll actuator mounted to the carriage and including a piston pivotably connected to an arm, the arm pivotably connected to the main plate, and a linkage pivotably connected between the piston and the carriage.

2. The table of claim 1 in which the roll actuator is an electric motor.

3. The table of claim 1 further including a tilt actuator subsystem including at least one tilt actuator mounted to the shuttle assembly and including a piston pivotably connected to the carriage for tilting the carriage.

4. The table of claim 1 in which the main plate includes opposing side guide rails.

5. The table of claim 4 further including a center section including opposing side channels for receiving the opposing side guide rails of the main plate.

6. The table of claim 5 further including a back section engageable with the center section.

7. The table of claim 6 further including a head section engageable with the back section.

8. The table of claim 6 further including a leg section engageable with the center section.

9. The table of claim 1 in which the base plate includes casters mounted on the bottom of the base plate for moving the base plate.

10. A medical procedure table comprising:

a base plate;

a base column extending upwards from the base plate;

a shuttle assembly telescopingly mounted to the base column;

a carriage pivotably mounted to the shuttle assembly;

a main plate pivotably mounted to the carriage and including a first set of opposing side guide rails; and a center section including opposing side channels received over the first set of opposing side guide rails of the main plate for removing the center section from the main plate, the center section including a second set of opposing guide rails for accepting an accessory device.

11. The table of claim 10 further including:

a roll actuator with a piston; and a linkage subsystem including an arm pivotably connected to the piston and to the main plate.

12. The table of claim 11 in which the roll actuator includes an electric motor.

13. The table of claim 11 in which the linkage subsystem further includes a link pivotably connected to the piston and to the carriage.

14. The table of claim 10 in which the first and second sets of opposing side guide rails have substantially similar cross sectional profiles.

15. The table of claim 10 in which the first and second sets of opposing side guide rails include accessory rails.

16. The table of claim 10 further including a tilt actuator subsystem including at least one tilt actuator mounted to the shuttle and including a piston pivotably connected to the carriage for tilting the carriage.

17. The table of claim 10 further including a back section engageable with the center section.

18. The table of claim 17 further including a head section engageable with the back section.

19. The table of claim 10 further including a leg section engageable with the center section.

20. The table of claim 10 in which the base plate includes casters mounted on the bottom of the base plate for moving the base plate.

21. A medical procedure table comprising:

a base plate;

a base column extending upwards from the base;

a shuttle assembly telescopingly mounted to the base column;

a carriage pivotably mounted to the shuttle assembly;

a main plate pivotably mounted to the carriage, the main plate including opposing side guide rails; and a roll actuator subsystem including:

a roll actuator mounted to the carriage and having a stroke motion in a first direction, and a linkage subsystem connected between the roll actuator and the main plate, the linkage subsystem configured to translate the stroke motion of the roll actuator to motion transverse to the first direction to roll the main plate.

22. The table of claim 21 in which the roll actuator is an electric motor.

23. The table of claim 21 further including a tilt actuator subsystem including at least one tilt actuator mounted to the shuttle and a piston pivotably connected to the carriage for tilting the carriage.

24. The table of claim 21 further including a center section including opposing side channels received over the opposing side guide rails of the main plate.

25. The table of claim 24 further including a back section engageable with the center section.

26. The table of claim 25 further including a head section engageable with the back section.

27. The table of claim 25 further including a leg section engageable with the center section.

28. The table of claim 21 in which the base plate includes casters mounted on the bottom of the base plate for moving the base plate.

29. The table of claim 21 in which the roll actuator includes a piston and in which the linkage subsystem includes an arm pivotably connected to the piston and to the main plate.

30. The table of claim 29 in which the linkage subsystem further includes a linkage pivotably connected to the piston and to the carriage.

31. A medical procedure table comprising:

a base plate;

a base column extending upwards from the base plate;

a shuttle assembly telescopingly mounted to the base column;

a carriage pivotably mounted to the shuttle assembly;

a main plate pivotably mounted to the carriage and including a first set of opposing side guide rails;

a center section including opposing side channels received over the first set of opposing side guide rails of the main plate for removing the center section from the main plate, the center section including a second set of opposing guide rails for accepting an accessory device;

a roll actuator with a piston; and a linkage subsystem including an arm pivotably connected to the piston and to the main plate.

32. The table of claim 31 in which the roll actuator includes an electric motor.

33. The table of claim 31 in which the linkage subsystem further includes a link pivotably connected to the piston and to the carriage.

* * * * *